United States Patent [19]

Clarke

[11] 4,082,216

[45] Apr. 4, 1978

[54] CARTON AND BAG CONTAINER

[75] Inventor: John W. Clarke, Indianapolis, Ind.

[73] Assignee: Eli Lilly and Company, Indianapolis, Ind.

[21] Appl. No.: 766,274

[22] Filed: Feb. 7, 1977

[51] Int. Cl.[2] ..... B65D 33/02

[52] U.S. Cl. ..... 229/55

[58] Field of Search ..... 229/41 B, 55, 14 BA, 229/14 BL

[56] References Cited

U.S. PATENT DOCUMENTS

| | | | |
|---|---|---|---|
| 2,717,731 | 9/1955 | Nerenberg | 229/14 BA |
| 2,766,926 | 10/1956 | Thompson | 229/55 |
| 2,802,617 | 8/1957 | Roper | 229/55 |
| 2,930,517 | 3/1960 | Mensing et al. | 229/41 B X |
| 3,249,286 | 5/1966 | Palmer | 229/55 |
| 3,430,845 | 3/1969 | Susuki et al. | 229/55 X |

FOREIGN PATENT DOCUMENTS

| | | | |
|---|---|---|---|
| 502,558 | 5/1954 | Canada | 229/55 |
| 627,711 | 8/1949 | United Kingdom | 229/55 |
| 651,638 | 4/1951 | United Kingdom | 229/55 |

*Primary Examiner*—Stephen Marcus

*Attorney, Agent, or Firm*—Houston L. Swenson; Arthur R. Whale

[57] ABSTRACT

A collapsible carton and plastic bag container is provided from a single sheet of plastic material and a single layer of paper board which is affixed to the plastic sheet material.

3 Claims, 5 Drawing Figures

CARTON AND BAG CONTAINER

BACKGROUND OF THE INVENTION

The use of plastic sheet material formed into bags has grown significantly over the past decade. These containers generally provide air tight features at a relatively low cost. However, in many instances, it is desirable to be able to readily pour material from the plastic bag. The flexibility of these bags make controlled pouring difficult. Various container designs have been made which operate on the principle of providing reinforcement in the plastic bags to give them added strength and rigidity. U.S. Pat. No. 3,682,372, Rodley, teaches a construction for a bag having a reinforced bottom. Although this provides strength in the transporting of the bag when filled it does not assist substantially in being able to pour part of the contents of the bag. U.S Pat. No. 3,896,991, Kozlowski et al., teaches the use of a combination of plastic sheet material and paper board for providing a reinforced bag. The assembly of this container is substantially different from that of my novel structure.

SUMMARY OF THE INVENTION

My container comprises a layer of plastic sheet material that is bonded together with a paper board carton blank therein. Upon folding the carton blank and plastic sheet material and sealing the side edges of the plastic sheet material a container is formed which has an exterior plastic bag with reinforced interior bottom and side walls enabling one to pour out the contents of the container.

DESCRIPTION OF THE PREFERRED EMBODIMENT

Figure 1:
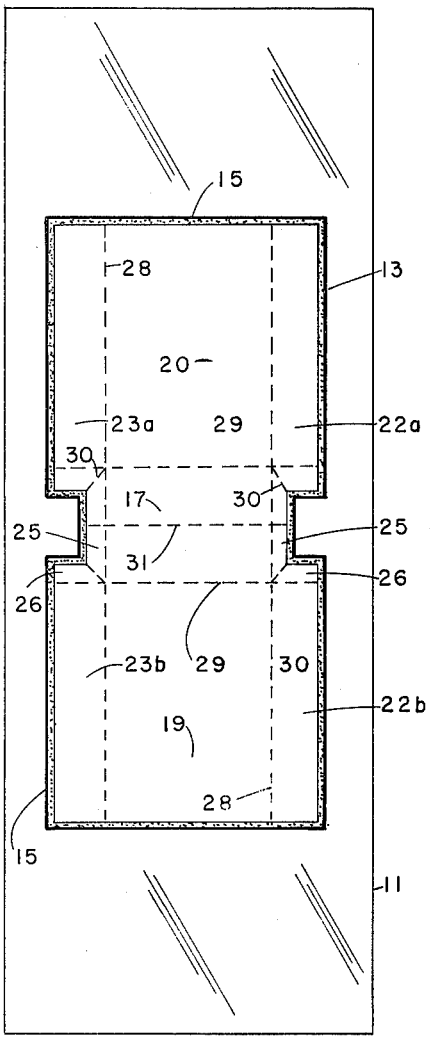
FIG. 1 is a top plan view of the interior paper board carton blank adhered to a sheet of plastic material.

Referring to FIG. 1 a plastic sheet material 11 of rectangular configuration is laid out for receiving a carton blank 13. Blank 13 is affixed to the plastic sheet material along its perimeter by an adhesive 15. If the paper board material is coated with a polyethylene material it can be sealed to the plastic sheet material by a conventional application of heat.

Carton blank 13 has a base panel 17 and a front panel 19 and back panel 20. Extending from the front and back panels are two pairs of split side panels *22a, 22b* and *23a, 23b*. A pair of first gusset panels 25 extend from base panel 17 with a second pair of cooperating gusset panels 26 extending from the split side panels. A pair of longitudinally extending crease lines 28 are formed in the blank with a pair of crease lines 29 extending transversely. Four gusset crease lines 30 are also formed in the blank for the purpose of being able to inwardly fold the gussets. Crease line 31 is formed in the blank midway along the length of base panel 17.

Figure 2:
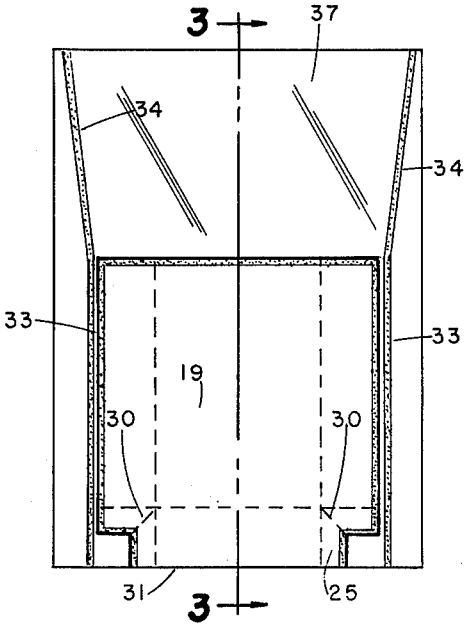
FIG. 2 is the top plan view of the structure of FIG. 1 after it has been folded along its midway point.
Figure 3:
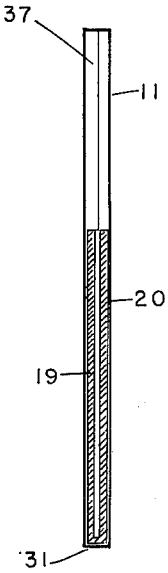
FIG. 3 is a view taken in cross section along line 3—3 of FIG. 2.

To further assemble the container after the paper board blank has been affixed to the plastic sheet material, the combination is folded along line 31 to take the position illustrated in FIGS. 2 and 3. In conjunction with this folding step the plastic sheet material is cemented together at its doubled-over side edges along adhesive lines 33 and 34. It is to be noted that lines 33 are just adjacent the edges of the split side panels and that lines 34 have a slight outward taper. The carton is now fully assembled and ready for erection.

Figure 4:
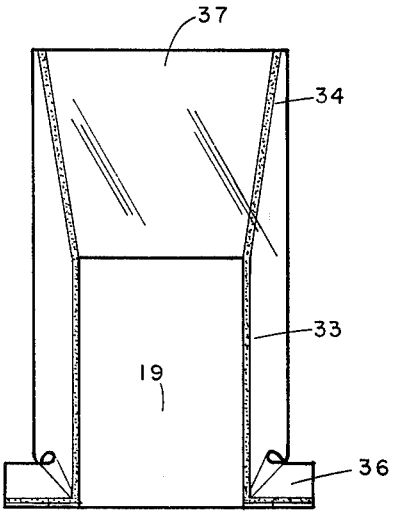
FIG. 4 is a front view of the assembled container.
Figure 5:
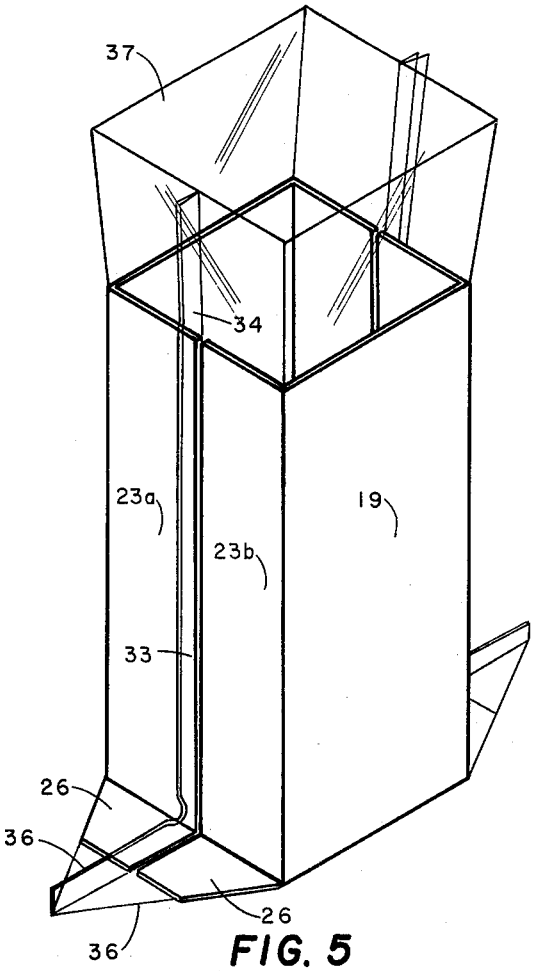
FIG. 5 is a perspective view of the container assembled and erected for receiving material.

The erection of the container to assemble the position of FIGS. 4 and 5 can be done by simply inserting one's hand into the plastic bag and spreading outwardly the front and back panels 19 and 20 of the carton blank. If this is done with the the blank in an upright position and on a flat surface pressure may be exerted downwardly as the front and back panels are spread to cause the folded bottom panel to assume a flat position. The container gussets 36 then extend outwardly at a right angle and may be folded upwardly and taped in such a position if so desired. In many instances, the use of the container will be in conjunction with a preformed support receptacle that will maintain the gusset in an upwardly bent position against the side panels. A simple piece of tape or a band about the container will also readily kept the gussets folded in an upward position.

Extension 37 of the plastic sheet material is illustrated in FIG. 5 as being slightly tapered in an outward fashion. This can serve as a funnel for receiving the contents of the container. After filling the container this extension can be stuffed downwardly into the container and a lid may be placed thereon. To remove the contents of the container the extension may be folded downwardly on the outside of the container thereby enabling one to pour all or part of the contents out over the edge of the container paper board panels. The container is reusable and may be folded into a flat position such as that of FIG. 2 by simply lowering the gussets and pressing on the sides to collapse it.

This container has been found to be particularly useful in handling light weight materials such as pharmaceutical hard shell empty gelatin capsules. These light weight capsules have a tendency to build up a static charge if they are contained against a plastic material. This problem does not result when the plastic bag is lined with a reinforced paper board material along the lines of my invention. If only a plastic bag had been used the result would have been a container that is extremely flexible making it difficult to pour out only a controlled amount of the contents. Thus, this container over comes problems of static electricity as well as being sufficiently rigid to receive and dispense its contents. In addition, these containers can be stored in great quantities by stacking them in their flat condition.

I claim:

1. The combination of an integral and collapsible interior carton and exterior plastic bag container comprising a paperboard carton blank affixed along its entire perimeter to a film of plastic sheet material, said carton blank having a base panel with a crease line bisecting it and with front and back panels extending therefrom at opposite front and back edges, a pair of split side panels extending from opposite side edges of each of said front and back panels, first gusset panels extending from opposite side edges of said base panel, second gusset panels extending from the lower edges of said split side panels, said carton blank being creased for folding along each panel edge from which another panel extends, and said plastic sheet material being cemented together along doubled-over side edges adjacent said split side panels.

2. The combination of claim 1 in which said plastic sheet material has an extension beyond the carton's opening which is tapered outwardly.

3. The combination of claim 2 in which said side panels and said gussets extending from said base panel are defined by a pair of longitudinally extending crease lines.

* * * * *